US007732689B1

(12) United States Patent
Jiang et al.

(10) Patent No.: US 7,732,689 B1
(45) Date of Patent: Jun. 8, 2010

(54) FOLDABLE AND HEIGHT ADJUSTABLE SUPPORT FOR MUSICAL INSTRUMENT USED IN SEATED POSITION

(76) Inventors: Ying Jiang, 172 Dellgrove Circle, Cambridge, Ontario (CA) N1T 2J8; Lily Wen Ruo Yan, 172 Dellgrove Circle, Cambridge, Ontario (CA) N1T 2J8

( * ) Notice: Subject to any disclaimer, the term of this patent is extended or adjusted under 35 U.S.C. 154(b) by 0 days.

(21) Appl. No.: 12/365,154

(22) Filed: Feb. 3, 2009

(51) Int. Cl.
*G10D 3/00* (2006.01)

(52) U.S. Cl. ..... 84/327; 84/453; 248/443

(58) Field of Classification Search ..... 84/327, 84/453; 248/443, 910
See application file for complete search history.

(56) References Cited

U.S. PATENT DOCUMENTS

| | | | | | |
|---|---|---|---|---|---|
| 752,664 | A * | 2/1904 | Foley | 84/327 |
| 1,176,184 | A * | 3/1916 | Venter | 248/629 |
| 1,261,841 | A * | 4/1918 | Mortensen | 84/327 |
| 1,272,583 | A * | 7/1918 | Vrubel | 84/327 |
| 1,285,802 | A * | 11/1918 | Russell | 84/327 |
| 1,369,742 | A * | 2/1921 | Halpin | 248/175 |
| 1,684,912 | A * | 9/1928 | Dunklau | 211/85.6 |
| 1,708,285 | A * | 4/1929 | Truett et al. | 84/327 |
| 1,802,236 | A * | 4/1931 | Carroll et al. | 84/327 |
| 1,907,238 | A * | 5/1933 | Blondin | 84/327 |
| 1,945,162 | A * | 1/1934 | Rasmussen | 84/327 |
| 2,814,229 | A * | 11/1957 | Vaccaro et al. | 84/327 |
| 3,979,993 | A * | 9/1976 | Proctor | 84/327 |
| 4,213,369 | A * | 7/1980 | Swartwout | 84/284 |
| 4,966,062 | A * | 10/1990 | Driggers et al. | 84/327 |
| 5,202,527 | A * | 4/1993 | Gracie | 84/327 |
| 5,388,492 | A * | 2/1995 | Olson | 84/327 |
| D360,427 | S * | 7/1995 | Gracie | D17/20 |
| 6,005,175 | A * | 12/1999 | Johnson | 84/327 |
| 6,252,150 | B1 * | 6/2001 | Johnson | 84/327 |
| 6,576,823 | B1 * | 6/2003 | Wise, Jr. | 84/327 |
| 7,205,468 | B1 * | 4/2007 | Johnson | 84/327 |
| 2008/0196572 | A1 * | 8/2008 | Navarro | 84/327 |

OTHER PUBLICATIONS

Rowley, Richard, Work Rest and Play: A Look at Guitar Supports, viewed Feb. 25, 2010 at http://www.staffordguitar.com/reviews2.asp.*

* cited by examiner

*Primary Examiner*—Jeffrey Donels
*Assistant Examiner*—Robert W Horn

(57) ABSTRACT

One embodiment of a foldable and height adjustable playing support for musical instrument that supports an instrument such as a guitar in the playing position while the musician is in the seated position. When in use it supports the instrument's bottom surface with its top instrument supporting surface and its bottom portion, the body contacting surface, rests on the performer's thigh. The support provides the performer various height adjustments to achieve the most comfortable playing position. When not in use it can be flattened to a form that is easy to carry and travel with.

2 Claims, 7 Drawing Sheets

FOLDABLE AND HEIGHT ADJUSTABLE SUPPORT FOR MUSICAL INSTRUMENT USED IN SEATED POSITION

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to an accessory for a musical instrument and more particularly, but not by way of limitation to, an apparatus for supporting a guitar or like instrument in the manner where the performer is seated and the instrument is held at the proper oblique playing position by resting the underside of the instrument upon the thigh.

2. Prior Art

In the past, a foot stool that elevates ones leg have been used to bring the players leg up, in turn to support the instrument at the desired height. The biggest disadvantage of this technique is that the player's body is positioned in such way that it often leads to back pain, leg cramp or numbness. These conditions will cause discomfort to the player and distract the player from playing or performing. The poor posture may even cause chronicle pain if the foot stool is used for a long period of time.

There has been support apparatus designed for use while the player is in playing position and supports the underside of the instrument to improve the player's posture (patent to Olson U.S. Pat. No. 5,388,492, patent to Diggers et al. U.S. Pat. No. 4,966,062, and patent to Johnson U.S. Pat. No. 6,252,150 B1). The main disadvantage of these apparatuses is that the support is attached to the instrument using attachments such as suction cups. Fine adjustments of the instrument relative to the apparatus are extremely tedious. These supports will not be very useful for instruments with small bottom surface, such as a travel guitar or an electric guitar, since the suction cups will not attach properly. Another disadvantage of these apparatuses is that the attachments may damage the finish of an instrument such as a delicate French polish on a classical guitar.

While there has been other instrument support apparatuses designed for use while the player is in playing position and supports the underside of the instrument without attaching to the instrument such as the Support Cushion for Plucked String Instrument (patent to Proctor U.S. Pat. No. 3,979,993). The main disadvantage of this design is that the cushion height can not be changed, making such cushion difficult to hold or travel with. The lack of height adjustment also does not allow the player to adjust in order to achieve the desired support height. Another disadvantage of this apparatus is that it is attached to the player's leg, therefore will stick out and spoil the appearance when the player bows.

While a variety of instrument support apparatuses have been provided, there has not been a support apparatus that's not attached to the instrument offered for the seated playing position that allows the player to play in a comfortable and desirable position by providing the player the ability to adjust the height of the support between the player's thigh and the underside of the instrument. The subject instrument support apparatus provides the player the choice of a number of heights between the instrument and the player's thigh and reduces the possibility of damaging the instrument surface because it is not attached to the instrument. It can accommodate a greater variety of plucked instrument that could be played in the seated position. It also provides the players the ability to hold and travel with ease because it can be folded to a compact form.

SUMMARY

In accordance with one embodiment of a music instrument support for use in seated position comprising a main support frame that holds a collapsible and height adjustable instrument support portion and a foldable body contacting portion.

DRAWINGS

Figures

Figure 1A:
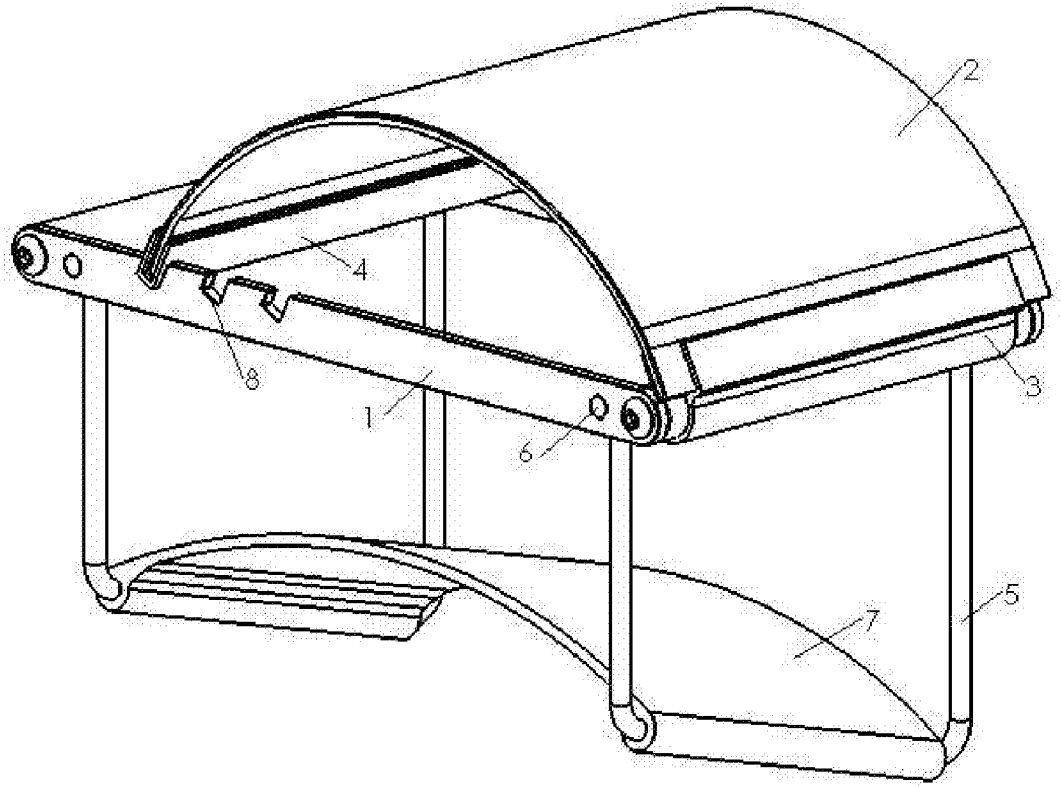
FIG. 1A shows the perspective view of the fully extended foldable and height adjustable support for musical instrument used in seated position.

| DRAWINGS-REFERENCE NUMERALS | |
|---|---|
| 1 | main supporting frame |
| 1a | rods |
| 1b | plates |
| 2 | instrument supporting surface |
| 2a | core |
| 2b | top surface |
| 3 | pivot mechanism |
| 3a | channel |
| 3b | tube |
| 4 | clamp |
| 5 | foldable supporting elements |
| 6 | ends |
| 7 | body contacting surface |
| 8 | slots |

DETAILED DESCRIPTION

Preferred Embodiment (FIGS. 1A, 1B, 1C, 2, 3A, 3B, 3C)

Figure 1B:
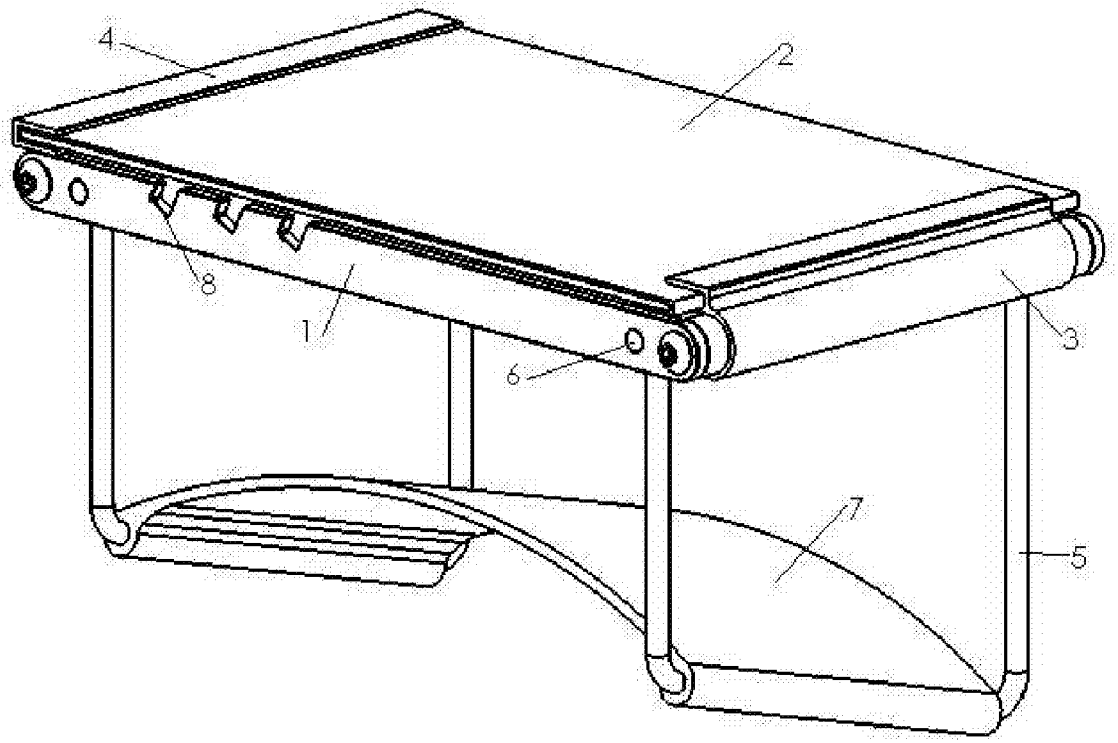
FIG. 1B shows the perspective view of the foldable and height adjustable support for musical instrument used in seated position with only the body contacting portion extended.
Figure 1C:
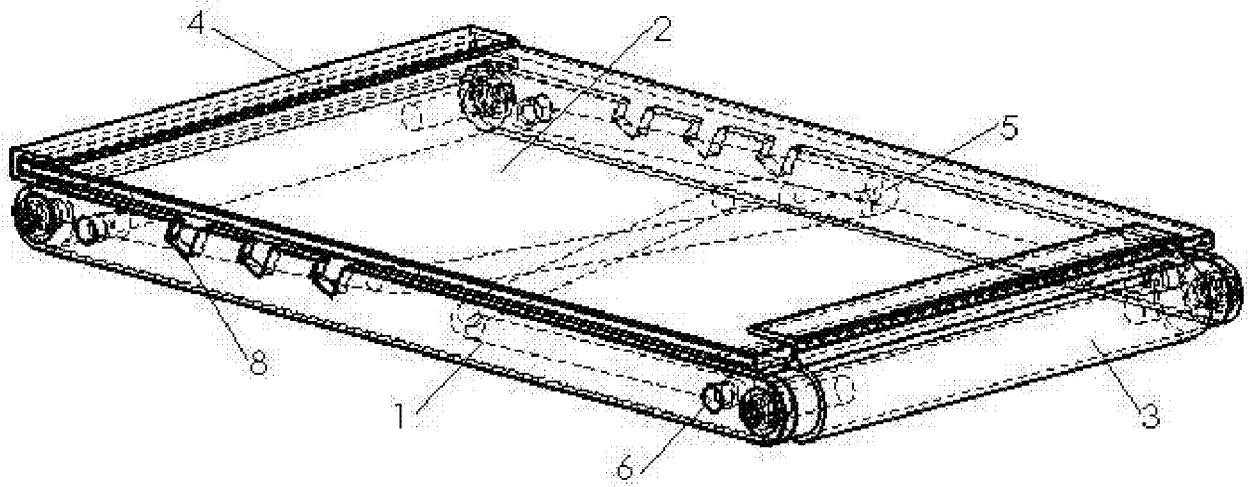
FIG. 1C shows perspective view of the fully retracted foldable and height adjustable support for musical instrument used in seated position.
Figure 2:
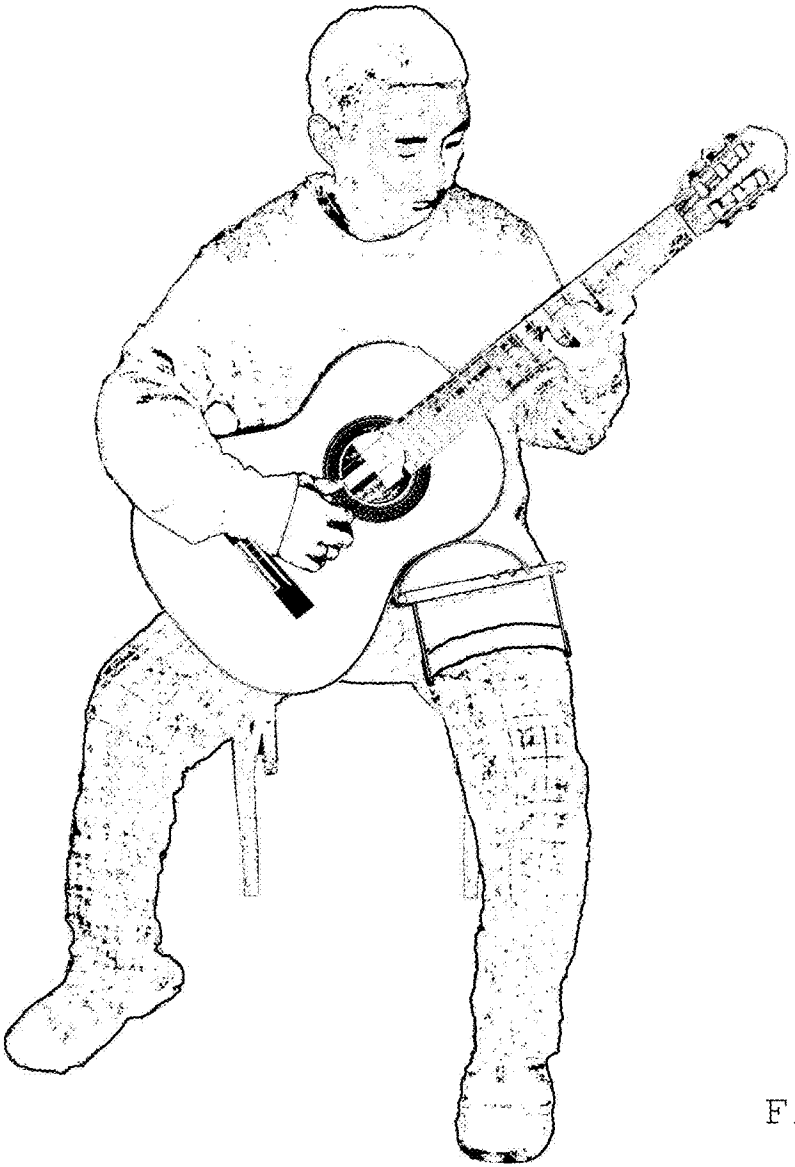
FIG. 2 shows the foldable and height adjustable support for musical instrument in the seated playing position relative to the instrument and the performer.
Figure 3A:
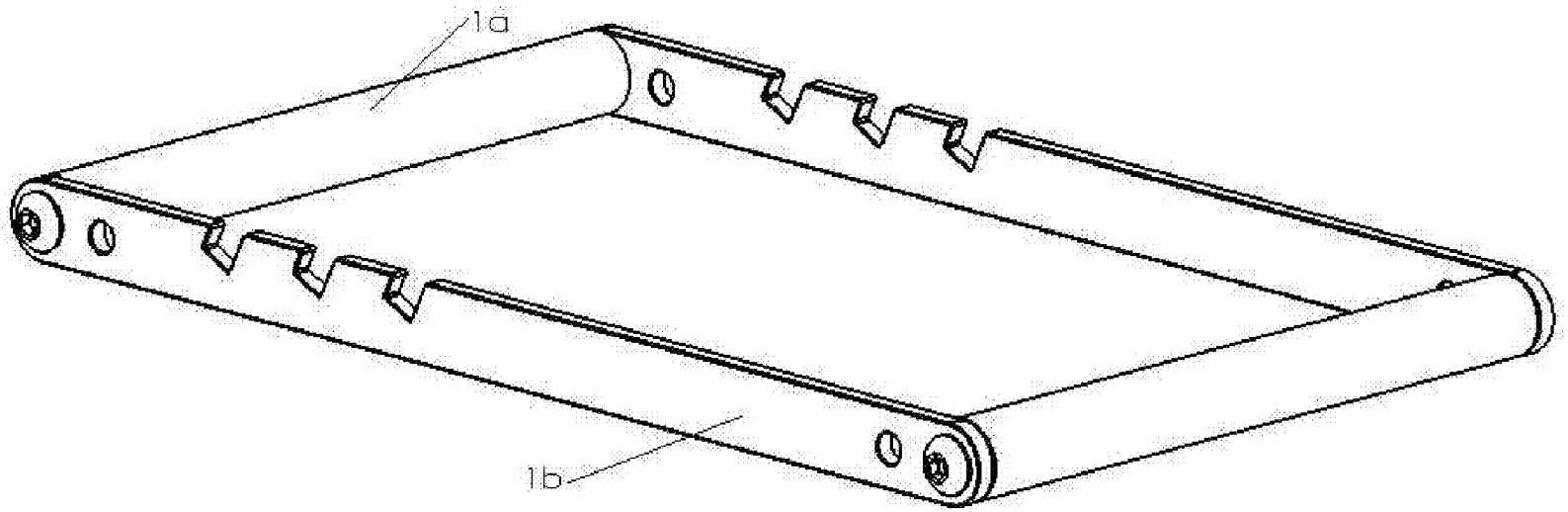
FIG. 3A shows a detailed perspective view of the main supporting frame.
Figure 3B:
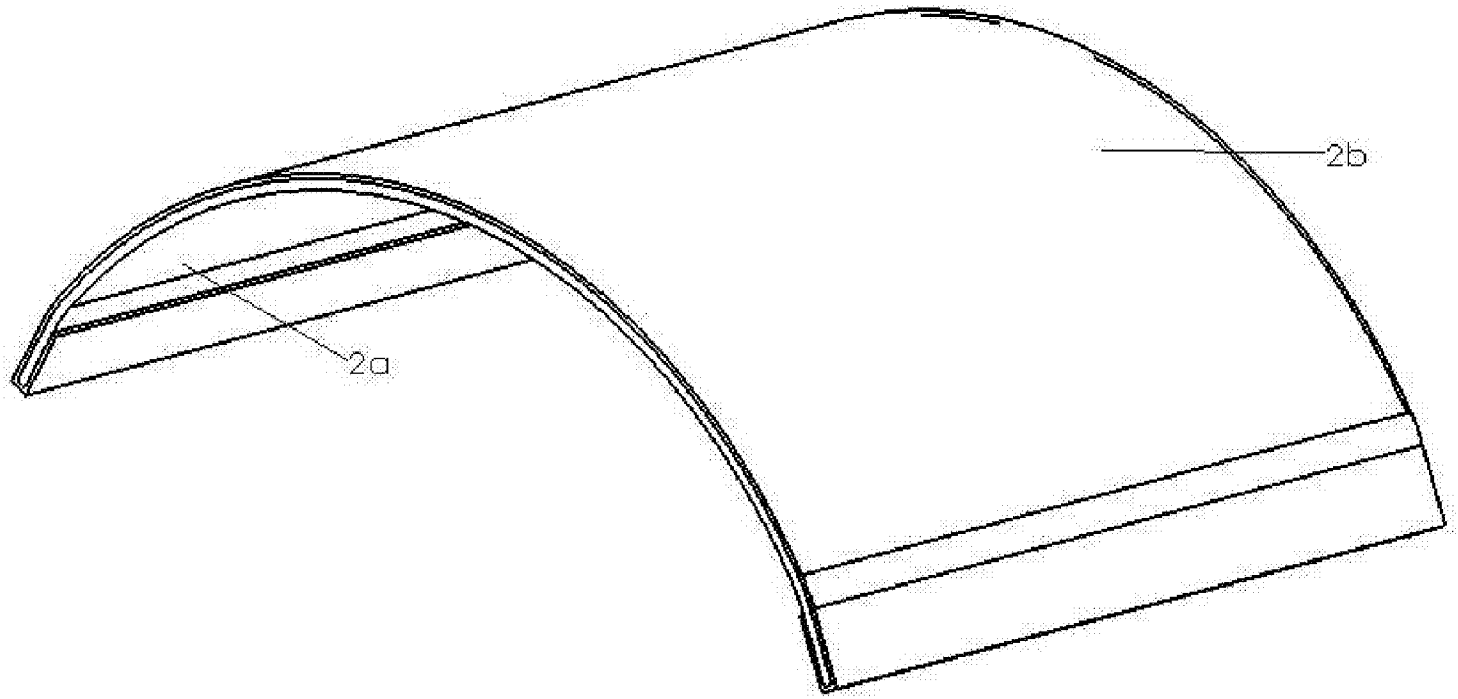
FIG. 3B shows a detailed perspective view of the instrument supporting surface.
Figure 3C:
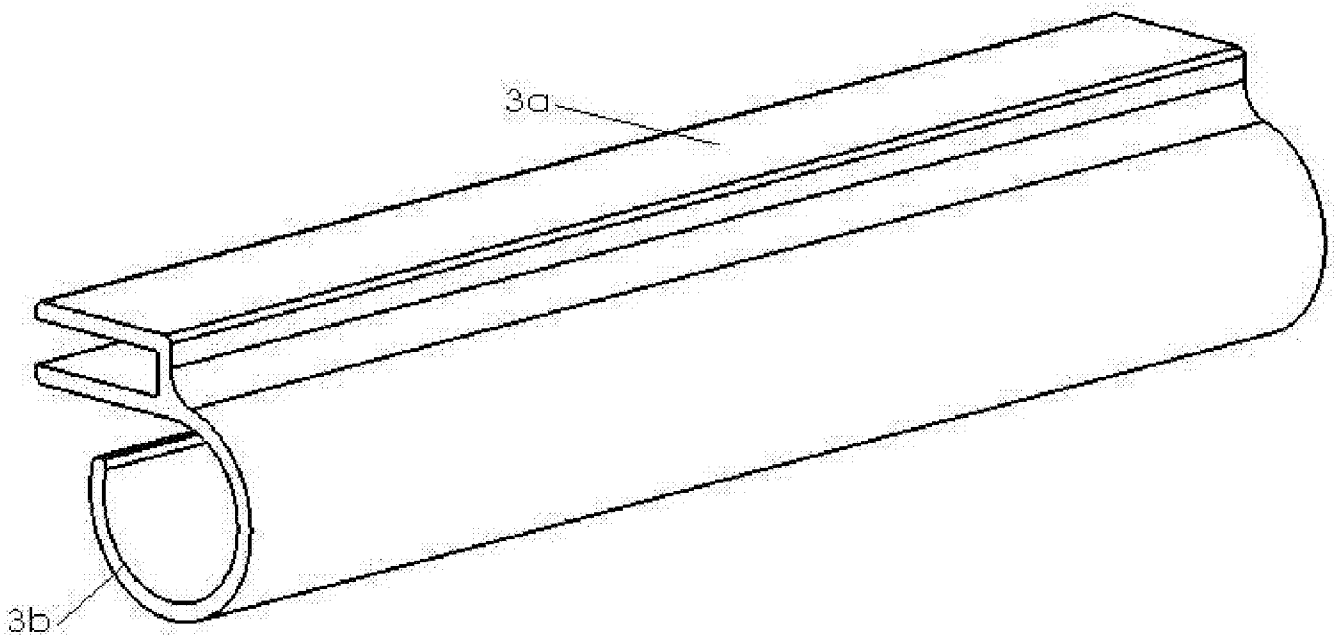
FIG. 3C shows a detailed perspective view of the pivot mechanism.

One embodiment of the support is illustrated in FIG. 1A (Perspective View—Fully Extended), FIG. 1B (Perspective View—Extended Body Contacting Portion Only), and FIG. 1C (Perspective View—Fully Retracted). This embodiment is the way this support is envisioned, but the design is not restricted to what is stated in description of this embodiment. FIG. 2 shows the instrument playing support in playing position relative to the instrument and the performer. FIGS. 3A, 3B, and 3C illustrate detailed components of main supporting frame (1), instrument supporting surface (2), and pivot mechanism (3) respectively.

The support has a main supporting frame (1) that is an assembly of two rods (1*a*) and two plates (1*b*). As shown on FIG. 3A, the rods (1*a*) are inserted into the plates (1*b*) through the clearance holes on either ends of each plate (1*b*). Each ends of the rods (1*a*) are tapped with screw holes which are exposed through the clearance holes on the plates (1*b*). To build the main supporting frame (1), screws are used to assemble the rods (1*a*) and plates (1*b*) together through the screw holes at the ends of the rods (1).

In the preferred embodiment, the main supporting frame (1) is made with aluminium.

The plates (1*b*) have slots (8) cut into the material at predetermined locations with predetermined angles that matches on both plates (1*b*) to accommodate the instrument supporting surface (2) in bent positions thereby allowing the instrument supporting surface (2) to be locked at various instrument support heights.

The instrument supporting surface (2) has a core (2*a*) made with a flexible sheet of material that can be bent and straightened without fracturing. In the preferred embodiment the instrument supporting surface core (2*a*) is made with a thin low density polyethylene sheet.

As demonstrated on FIG. 3B, the core (2*a*) of the instrument supporting surface (2) is wrapped by a top surface (2*b*) that is non-slip and non-abrasive. In the preferred embodiment, the top surface (2*b*) is made with leather.

A pivot mechanism (3) in this embodiment made with stainless steel shown in FIG. 3C consists of a channel (3*a*) that clamps the instrument supporting surface (2) in place and a tube (3*b*) that simply rotates around the rod (1*a*) on the main supporting frame (1) allowing the pivoting motion between the instrument supporting surface (2) and the main supporting frame (1).

The top surface (2*b*) is clamped onto the core (2*a*) of the instrument supporting surface (2) with a clamp (4) on the opposite side of the pivot mechanism (3).

The support has two foldable supporting elements (5) made out of stainless steel wire.

The foldable supporting elements (5) are bent into a predetermined 'U' like shape with flared out ends (6), these ends (6) will be inserted into clearance holes at predetermined locations on the plates (1*b*) of the main supporting frame (1). Each foldable supporting element (5) is connects to both plates (1*b*) of the main supporting frame (1) with its two ends.

In the preferred embodiment, the foldable supporting elements (5) are attached to the main supporting frame (1) through clearance holes and can be easily removed and reversed in direction to accommodate a left handed performer.

In the preferred embodiment, each of the predetermined 'U' like shape of the foldable supporting elements (5) is longer on the side away from the performer then the side close to the performer. This configuration will allow the performer to play in a more ergonomic position.

In the preferred embodiment, a non-slip and non-abrasive body contacting surface (7) made with a strip of leather is connected the two foldable supporting elements (5) by wrapping around the bottom of the 'U' like shape and sewn back onto itself. When the foldable supporting elements (5) are in their fully extend position the body contacting surface (7) will fit comfortably on the performer's lap.

OPERATION

Preferred Embodiment (FIGS. 1A, 1B, 1C and 2)

Illustrations FIGS. 1A, 1B and 1C demonstrates the operations of preferred embodiment. FIG. 2 shows the instrument playing support in playing position relative to the instrument and the performer.

The instrument playing support can be stored in a compact configuration, shown in FIG. 1C, where the instrument supporting surface (2) is in a flat position against the main supporting frame (1) and the two foldable supporting elements (5) is tucked inside the main supporting frame (1) in the folded position. FIG. 1C does not show the body contacting surfaces (7) in order to clearly show the folded configuration. In reality the leather used for the body contacting surfaces (7) will fold neatly under main supporting frame (1) between the two foldable supporting elements (5).

The two foldable supporting elements (5) could be rotated from the folded positioned (FIG. 1C) to extended position (FIG. 1B) In the extended position the body contact surface (7) is stretched and can be comfortably place on the performer's lap (FIG. 2).

The instrument playing support's instrument supporting surface (2) could pivot upward into an elevated position, shown in FIG. 1A, from a flat position, shown in FIG. 1B, against the main supporting frame (1). The instrument supporting surface (2) could be locked in position by inserting the free end of the instrument supporting surface (2) to one of the predetermined slots (8) cut on the main supporting frame (1). The instrument can be directly place on the instrument supporting surface (2) as shown in FIG. 2. The instrument playing support has more than one elevated positions for the instrument supporting surface (2) to provide the player choices of preferred instrument support heights. In the preferred embodiment, there are 3 slots (8) on the main supporting frame (1), providing 3 height changes in the instrument support.

CONCLUSION, RAMIFICATIONS, AND SCOPE

Accordingly, the reader will see that the foldable and height adjustable support for musical instrument used in seated position is simple to use and convenient for storage and travel. The foldable and height adjustable support for musical instrument used in seated position allows the player to play in a comfortable and desirable position by providing the player the ability to adjust the height of the support between the player's thigh and the underside of the instrument. In addition, the foldable and height adjustable support for musical instrument used in seated position is gentle on the instrument and is comfortable for the performer's thigh. The support is very versatile. It can be adjusted so it can be used by both left and right handed players and it can be used for a variety of plucked instrument that could be played in the seated position.

While the above description contains many specifics, these should not be construed as limitations on the scope of any embodiment, but as exemplifications of the presently preferred embodiment thereof. Many other ramifications and variations are possible. For example, Instead of what has been described in the preferred embodiment, the main supporting frame (1) can be also made with a machined or moulded solid piece of material or a strip of solid or sheet material wrapped around to form a frame.

In the preferred embodiment, the main supporting frame (1) is made with aluminium; however, any rigid material such as other metal, hard plastic or wood can also be used.

In the preferred embodiment, the slots (8) cut onto the main supporting frame (1) could also be a predetermined wave like channels cut onto the plates (1*b*) of the main supporting frame (1) to work in combination with side extensions of the clamp (4) or it could be a set of spring loaded clamps that could fix the instrument supporting surface (2) to predetermined locations to achieve preferred final support heights.

In the preferred embodiment the core (2*a*) is made with a thin low density polyethylene sheet, however, any flexible material that can be bent and straightened without fracturing and can support weight of an instrument such as a guitar in bent position can be used.

The tube (3*b*) rotating around the rod (1*a*) in the preferred embodiment pivot mechanism (3) can be replaced with a hinge or a housing of ball bearings.

In the preferred embodiment, the channel (3*a*) acts as a clamp to fasten the instrument supporting surface (2) onto the pivot mechanism (3), a flat piece of material at the end of the pivot mechanism (3) and some rivet or glue can also be used to fasten the instrument supporting surface (2) to the pivot mechanism (3).

In the preferred embodiment, the pivot mechanism (3) is made of stainless steel; however, it can be made with any rigid material such other metal, hard plastic or wood.

In the preferred embodiment, the top surface (2*b*) is made with leather; however, it can be made with any non-slip and non-abrasive soft material such as woven fabric, rubber or soft plastic.

In the preferred embodiment, the top surface (2*b*) of the main supporting surface (2) is clamped onto the core (2*a*); this top surface can also be glued or riveted on.

In the preferred embodiment, the foldable supporting elements (5) is made with stainless steel wire, however, it can be made with moulded or bent solid rods or strips of any material that can shaped to the predetermined shape.

In the preferred embodiment, the predetermined 'U' like shape of the foldable supporting elements (5) are identical, however, the shape can be adjusted so that the length of the foldable supporting elements (5) on the left hand side of the performer is longer than the length of the foldable supporting elements (5) on the right hand side of the performer. This configuration will allow the performer to play in a more ergonomic position and could provide performer with more height differential between the performer's lap and the instrument.

In the preferred embodiment, the body contacting surface (7) is made with leather; however, it can be made with any non-slip and non-abrasive flexible material that's such as woven fabric, rubber or soft plastic.

In the preferred embodiment, the body contacting surface (7) is fastened to the foldable supporting elements (5) by wrapping around the bottom of the 'U' like shape and sewn back onto itself, it can also be glued, riveted or hook and loop fastened onto itself or onto the bottom of the 'U' like shape of the foldable supporting elements (5).

The above are some examples of ramifications and variations to the preferred embodiment.

Thus the scope of the invention should be determined by the appended claims and their legal equivalents, and not by the examples given.

What is claimed is:

1. A travel friendly foldable and height adjustable playing support for musical instruments such as a guitar for use in a seated position comprising:

a) a main supporting frame in an elongated shape having wide and narrow ends that accommodates an instrument support portion and a body contacting portion;

b) said instrument support portion comprising:

i) an instrument supporting surface that supports the instrument in playing position comprising one or more surfaces in the form of sheets that can be bent into a convex shape that may interface with the bottom of musical instrument in playing position and may be straightened to collapse against said main supporting frame without fracturing;

ii) a means to pivot said instrument supporting surface against one narrow end of said main supporting frame;

iii) a means to fasten said instrument supporting surface to said means to pivot;

iv) a means to fasten said means to pivot to said main supporting frame;

c) said body contacting portion comprising:

i) one or more body contacting surfaces in the form of sheet materials that conforms to the performer's thigh;

ii) one or more foldable supporting members with legs to provide height adjustment for the instrument playing support in the extended position, and an arm to stretch said body contacting surface across the performer's thigh;

iii) a means to fasten said body contacting surfaces to said foldable supporting members;

iv) a means to fasten said foldable supporting members to the wide ends of said main supporting frame;

d) a means to stop and lock the final support height created by said instrument support portion;

e) a means to fasten said stop and lock means to said main supporting frame.

2. The travel friendly playing support as defined in claim 1 wherein said instrument supporting surface further comprises a) a top surface, and b) a means to fasten said top surface of said instrument supporting surface to the main supporting frame.

* * * * *